United States Patent [19]

Manca et al.

[11] Patent Number: 4,837,105

[45] **Date of Patent: * Jun. 6, 1989**

[54] IMAGING PROCESS WITH PREVENTION OF TONER SPOTS

[75] Inventors: Richard D. Manca, Walworth; Thomas R. Hoffend, Webster; Don B. Jugle, Penfield, all of N.Y.

[73] Assignee: Xerox Corporation, Stamford, Conn.

[ * ] Notice: The portion of the term of this patent subsequent to Apr. 11, 2006 has been disclaimed.

[21] Appl. No.: 158,975

[22] Filed: Feb. 22, 1988

[51] Int. Cl.[4] ..... G03G 13/22

[52] U.S. Cl. ..... 430/126

[58] Field of Search ..... 430/110, 126

[56] References Cited

U.S. PATENT DOCUMENTS

| | | | |
|---|---|---|---|
| 2,986,521 | 5/1961 | Wielicki . | |
| 4,064,313 | 12/1987 | Takiguchi et al. | 428/447 |
| 4,142,982 | 3/1979 | Yamakami et al. . | |
| 4,311,779 | 1/1982 | Miyakawa et al. | 430/107 |
| 4,409,312 | 10/1983 | Ikeda et al. | 430/110 |
| 4,430,408 | 2/1984 | Sitaramiah | 430/106.6 |
| 4,460,672 | 7/1984 | Gruber et al. | 430/110 |
| 4,517,272 | 5/1985 | Jadwin et al. | 430/110 |
| 4,556,624 | 12/1985 | Gruber et al. | 430/110 |
| 4,701,686 | 7/1978 | Strella et al. . | |

FOREIGN PATENT DOCUMENTS

| | | |
|---|---|---|
| 1402010 | 7/1983 | United Kingdom . |

*Primary Examiner*—Roland E. Martin

[57] ABSTRACT

An electrophotographic imaging process which comprises the formation of a latent image on a photoconductive imaging member; thereafter developing the image with a toner composition comprised of resin particles, pigment particles, and a sulfur containing organopolysiloxane wax; subsequently transferring the developed image to a suitable substrate; and permanently affixing the image thereto, wherein there result images with an absence of unwanted toner spots thereon.

28 Claims, No Drawings

IMAGING PROCESS WITH PREVENTION OF TONER SPOTS

BACKGROUND OF THE INVENTION

This invention is generally directed to electrophotographic imaging processes, and more specifically xerographic imaging processes wherein there is avoided the localized accumulation of undesirable toner debris on the photoconductive imaging member. With the process of the present invention, there are permitted unwanted toner spots or comets, that is the prevention of the localized accumulation of undesirable toner debris on a photoconductive imaging member present in an imaging apparatus, which debris can encompass sufficient areas of the member thereby causing unwanted toner spots on the final developed output copies. In one embodiment, thus the present invention is directed to electrophotographic imaging processes which comprise the formation of an electrostatic image on a photoconductive imaging member, thereafer developing the image formed with a toner composition containing therein certain sulfur containing organopolysiloxane waxes, subsequently transferring the image to a suitable substrate, and permanently affixing the image thereto. In addition, the present invention is directed to imaging processes wherein offset preventing fluids such as silicone oils and the complex apparatuses associated with the use of such oils are avoided. Accordingly, there are permitted with the process of the present invention less complex systems and reduced maintenance of the imaging apparatus, while simultaneously avoiding the formation of undesirable toner debris or comets on the imaging member during the electrostatic imaging process.

Developer and toner compositions with certain waxes therein are known. For example, there are disclosed in U.K. Patent Publication No. 1,442,835 toner compositions containing resin particles and polyalkylene compounds, such as polyethylene and polypropylene of a molecular weight of from about 1,500 to 6,000, reference page 3, lines 97 to 119, which compositions prevent toner offsetting in electrostatic imaging process. Additionally, the '835 publication discloses the addition of paraffin waxes together with, or without a metal salt of a fatty acid, reference page 2, lines 55 to 58. Also, many patents disclose the use of metal salts of fatty acids for incorporation into toner compositions, such as U.S. Pat. No. 3,655,374.

Further, there is illustrated in Japanese Publication Abstract 130036/78 the incorporation of silicone resins into toners; while Japanese Patent Publication Abstract 48243/79 discloses the inclusion of silicone oils in toner compositions. Moreover, there are illustrated in Japanese Publication Abstracts 52,640; 55,954; 130,048; and 60,754 toners with silicone oils that enable the substantial elimination of offsetting. Furthermore, patents of background interest include U.S. Pat. Nos. 4,214,549 relating to the selection of functional silicones with a Viton fuser roll; 4,064,313; 4,142,982; 4,075,362; 4,287,280; 4,469,750; 4,142,982 discloses a low molecular weight solid silicone varnish as a toner additive; and 4,515,884. Also, disclosed in U.S. Pat. No. 3,346,405 are mercaptoalkyl substituted organopolysiloxanes, while U.S. Pat. No. 3,565,937 describes a method for preparing mercaptoalkyl organosilanes in which a silicon hydride group is added across the double bond of a sulfur substituted olefin. Other patents with similar disclosures include U.S. Pat. Nos. 3,388,144 and 4,046,795. None of the aforementioned prior art, however, illustrates the use of toner compositions with the novel organopolysiloxanes described herein, which toners are especially useful in electrostatic imaging systems wherein the formation of comets is substantially eliminated.

Moverover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica. Further, there are illustrated in U.S. Pat. No. 4,338,390, the disclosure of which is totally incorporated herein by reference, developer and toner compositions having incorporated therein as charge enhancing additives organic sulfate and sulfonate compositions. Also, in U.S. Pat. No. 4,298,672, the disclosure of which is totally incorporated herein by reference, there are disclosed positively charged toner compositions containing resin particles and pigment particles, and as a charge enhancing additive alkyl pyridinium compounds inclusive of cetyl pyridinium chloride. Other representative prior art disclosing positively charged toner compositions with charge enhancing additives include U.S. Pat. Nos. 3,944,493; 4,007,293; 4,079,014; and 4,394,430.

Other prior art of interest includes U.S. Pat. No. 4,517,272, which illustrates a silicone oil as a toner additive; 4,311,779, wherein silicone oils are added to styrene butadiene toner resins; 4,430,408, which illustrates the addition of liquid or solid silicones to toner compositions; and 4,568,642, which discloses the use of silicone oil with a functional group (amine) in a toner. Patents of background interest include British Pat. No. 1,402,010; U.S. Pat. Nos. 2,986,521; 3,974,078; 4,101,686; 4,556,624 and 4,565,773.

Additionally, illustrated in copending application U.S. Ser. No. 103,338 entitled Toner Developer Compositions With Sulfur Containing Organopolysiloxane Waxes, the disclosure of which is totally incorporated herein by reference, are imaging methods with toner compositions comprised of resin particles, pigment particles, and a sulfur containing organopolysiloxane wax, specific waxes being of the formula as illutrated, for example, in claim 2 of the aforementioned application. These sulfur waxes are also incorporated into the toner compositions selected for the process of the present invention. Furthermore, in copending application U.S. Ser. No. 004,939 with a filing date of Oct. 1, 1987, entitled Toner and Developer Compositions With Polymeric Alcohol Waxes, the disclosure of which is totally incorporated herein by reference, there are disclosed toner compositions comprised of resin particles, pigment particles, and a wax component comprised of polymeric alcohols of the formula indicated in claim 1, for example; and wherein n is a number of from about 30 to about 300. In this copending application with a filing date of Jan. 20, 1987, it is indicated that the toner and developer compositions of this invention simultaneously prevent the localized accumulation of undesirable toner debris upon the imaging member, which debris can encompass sufficient areas of the photoconductive members to permit unwanted toner spots to be present on the final developed output copy.

Although the above described toner and developer compositions are suitable for their intended purposes, that is electrophotographic imaging processes, for example, there is a need for improved processes wherein toner accumulation or cometing is avoided. More specifically, there remains a need for electrophotographic imaging processes with toner compositions containing certain organopolysiloxane waxes, and wherein the localized accumulation of undesirable toner debris upon photoconductive imaging members is eliminated thereby avoiding unwanted toner spots or comets on the final developed output copies. There also remains a need for xerographic imaging processes wherein copies of high quality with no background deposits are obtained, and wherein localized accumulating of undesirable toner debris on the photoconductive imaging member is avoided. This is also a need for positively charged toner compositions with certain organopolysiloxane waxes as illustrated hereinafter, which waxes may be present as external or internal components. Furthermore, there remains a need for toner compositions containing certain organopolysiloxane waxes, which compositions contain thereon a constant triboelectric charging value of from about 10 to about 30 microcoulombs per gram, and wherein these compositions are particularly useful in electrophotographic imaging processes that avoid toner accumulation or cometing on the imaging members selected.

SUMMARY OF THE INVENTION

It is an object of the present invention to provide electrophotographic imaging processes which possess the above noted advantages.

Another object of the present invention resides in the provision of electrophotographic imaging processes wherein undesirable toner debris is substantially eliminated from the photoconductive imaging member thereby avoiding unwanted toner spots on the final developed output copies.

Furthermore, there is a need for xerographic imaging processes wherein when toner compositions with certain organopolysiloxane waxes are selected there results images of high quality and excellent resolution; and also, wherein the images obtained do not contain any print deletions thereon as a result, for example, of the accumulation of undesirable toner debris on the photoconductive imaging member.

Another object of the present invention resides in the provision of xerographic imaging processes wherein release fluids such as silicone oils and the costly apparatuses associated therewith are avoided.

These and other objects of the present invention are accomplished by the provision of xerographic imaging processes wherein undesirable toner debris is avoided on the photoconductive imaging member, which toner compositions contain therein sulfur containing organopolysiloxane waxes. More specifically, in one embodiment of the present invention there is provided an electrophotographic process which comprises there is provided an electrophotographic process which comprises the formation of a latent image on a photoconductive imaging member; subsequently developing this image with a toner composition comprised of resin particles, pigment particles, and sulfur containing organopolysiloxane waxes; thereafter transferring the developed image to a suitable substrate; and permanently affixing the image thereto wherein the localized accumulation of undesirable toner debris on the photoconductive imaging member is avoided enabling unwanted toner spots to be eliminated from the final developed output copies.

With further respect to the process of the present invention, the toner compositions selected are comprised of resin particles pigment particles inclusive of magnetite, and sulfur containing organopolysiloxane waxes, which waxes are of the following formula, the waxes and processes for the preparation thereof being illustrated, for example, in Stauffer-Wacker Silicones Corporation application U.S. Ser. No. 945,124, Martin et al., entitled Sulfur Containing Organopolysiloxane Waxes, and A Method For Preparing the Same, the disclosure of which is totally incorporated herein by reference.

(1) at least three mole percent of siloxane units of the formula $$R_a-\overset{(R^1)_b}{\overset{|}{Si}}O_{\frac{4-a-b}{2}}$$

(2) at least one mole percent of siloxane units selected from the formulas $$\left(\overset{SH}{\overset{|}{R^2}}\right)_c \quad \text{and}$$
$$R_d-SiO_{\frac{4-c-d}{2}}$$

$$\overset{R_d}{\overset{|}{\underset{\frac{3-d}{2}}{O}Si}}-R^2-S-S-R^2-\overset{R_d}{\overset{|}{Si}}O_{\frac{3-d}{2}} \quad \text{and}$$

(3) from 0 to 96 mole percent of siloxane units of the formula $$R_eSiO_{\frac{4-e}{2}}$$

where R is a monovalent hydrocarbon radical having from 1 to 10 carbon atoms, $R^1$ is an alkyl radical linked to silicon with an SiC-bond, and which has at an average of least 25 carbon atoms, $R^2$ is a multivalent radical selected from a hydrocarbon radical having from 2 to 10 carbon atoms and which is free of aliphatic unsaturation, a hydrocarbon ether or a hydrocarbon thioether, a is an integer of from 0 to 2, b is an integer of 1 or 2, c is an integer of 1 or 2, d is an integer of from 0 to 2, e is an integer of from 0 to 3, and the sum of a+b is 1, 2 or 3, and the sum of c+d is 1, 2 or 3.

Furthermore, there are provided in accordance with the present invention positively charged toner compositions comprised of resin particles, pigment particles, the aforementioned sulfur containing organopolysiloxane waxes, and charge enhancing additives. Another embodiment of the present invention is directed to developer compositions comprised of the aforementioned toners and carrier particles. Accordingly, the present invention envisions the utilization of single component toner compositions, that is those comprised of resin particles, magnetite pigment particles such as Mapico Black, and the aforementioned sulfur containing organopolysiloxane waxes; and two component developer compositions comprised of toners with resin particles, pigment particles such as carbon black, organopolysiloxane waxes and carrier particles preferably containing a coating thereover. Additionally, the aforementioned toner and developer compositions can contain the wax as an internal additive or preferably as an external additive present, for example, on the surface of the toner particles.

Preferred sulfur containing organopolysiloxane waxes selected for the toner and developer compositions of the present invention contain (1) from about 3 to about 99, and more preferably from 5 to 99 mole percent of siloxane units of the formula $$R_a-\overset{(R^1)_b}{\overset{|}{Si}}O_{\frac{4-a-b}{2}}$$

(2) from 1 to 97 mole percent of siloxane units selected from the components represented by the following formulas $$\left(\overset{SH}{\overset{|}{R}}\right)_c \quad \text{and}$$

$$R_d-\overset{|}{Si}O_{\frac{4-c-d}{2}}$$

$$\underset{\frac{3-d}{2}}{\overset{R_d}{\overset{|}{O}}}Si-R^2-S-S-R^2-\underset{\frac{3-d}{2}}{\overset{R_d}{\overset{|}{Si}}}O \quad \text{and}$$

(3) from 0 to 96 mole percent of siloxane units of the formula $$R_eSiO_{\frac{4-e}{2}}$$

where R, $R^1$, $R^2$, a, b, c, d and e are as defined herein.

The sulfur containing organopolysiloxane waxes of this invention are prepared by reacting an alkyl functional silane of the formula $$R_aSi(R^3)_{4-a-b}^{(R^1)_b}$$

with a mercaptosilane of the formula $$R_dSi-(R^3)_{4-c-d}^{\left(\overset{SH}{\overset{|}{R^2}}\right)_c}$$

in the presence of water and solvent, in which R, $R^1$, $R^2$, a, b, c and d are as defined herein, and $R^3$ is a hydrocarbonoxy radical (OR) having up to 10 carbon atoms, or a halogen, such as chlorine, bromine, or iodine. When $R^3$ is a hydrocarbonoxy radical, then an acid catalyst having a pKa value of less than 1 is also utilized in the process.

Other silicone compounds which may be employed in the reaction are cyclic trisiloxanes of the formula $$(R_2SiO)_3$$

and/or organodisiloxanes of the formula $(R_3Si)_2O$ where R is as defined herein.

Examples of the various radicals, specific examples of reactants, and other information relating to the sulfur containing organopolysiloxane waxes, which waxes are available from Stauffer-Wacker Silicones Corporation, are illustrated in the referenced copending U.S. Ser. No. 945,124, and U.S. Ser. No. 103,338, the disclosures of which have been totally incorporated herein by reference. Generally, the wax is ground to a fine powder with an average volume medium diameter of from about 5 to about 30 microns, and preferably from about 8 to about 15 microns.

Illustrative examples of suitable toner resins selected for the toner and developer compositions of the present invention, and present in various effective amounts, such as for example from about 70 percent by weight to about 95 percent by weight, include polyamides, epoxy resins, polyurethanes, diolefins, vinyl resins and polymeric esterification products of a dicarboxylic acid, and a diol comprising a diphenol. Any suitable vinyl resin may be selected as the toner resin including homopolymers or copolymers of two or more vinyl monomers. Typical vinyl monomeric units include styrene, p-chlorostyrene, vinyl naphthalene, unsaturated monoolefins such as ethylene, propylene, butylene, isobutylene, and the like; vinyl halides such as vinyl chloride, vinyl bromide, vinyl fluoride, vinyl acetate, vinyl propionate, vinyl benozate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylamide, vinyl ethers, such as vinyl methyl ether, vinyl isobutyl ether, and vinyl ethyl ether; and N-vinyl indole; and N-vinyl pyrrolidone; styrene butadiene copolymers, especially styrene butadiene copolymers prepared by a suspension polymerization process, reference U.S. Pat. No. 4,558,108, the disclosure of which is totally incorporated herein by reference; styrene butadiene copolymers prepared by an emulsion polymerization process, reference U.S. Pat. Nos. 4,469,770, the discloure of which is totally incorporated herein by reference; and mixtures thereof.

As preferred toner resins there can be selected the esterification products of a dicarboxylic acid and a diol comprising a diphenol, reference U.S. Pat. No. 3,590,000, the disclosure of which is totally incorporated herein by reference. Other preferred toner resins included styrene/methacrylate copolymers and styrene/butadiene copolymers, especially those as illustrated in the aforementioned patents; Pliolites; polyester resins obtained from the reaction of bisphenol A and proplyene oxide, followed by the reaction of the resulting product with fumaric acid; branched polyester resins resulting from the reaction of dimethylterephthalate, 1,3-butanediol, 1,2-propanediol, and pentaerythritol, crosslinked styrene methacrylates, and the like.

Numerous well known suitable pigments or dyes can be selected as the colorant for the toner particles including, for example, carbon black, nigrosine dye, aniline blue, phthalocyanine derivatives, magnetites and mixtures thereof. The pigment, which is preferably carbon black, is present in a sufficient amount to render the toner composition colored in order that they will permit the formation of a clearly visible image. Generally, the aforementioned pigment particles are present in amounts of from about 3 percent by weight to about 20 percent by weight, based on the total weight of the toner composition; however, lesser or greater amounts of pigment particles can be selected providing the objectives of the present invention are achieved. Mixtures of magnetites and the aforementioned pigments can also be selected, which mixtures contain, for example, from about 15 to about 35 percent by weight of magnetite, and from about 3 to about 15 percent by weight of pigment particles.

When the pigment particles are comprised of magnetites, thus enabling single component toner compositions which magnetites are a mixture of iron oxides ($FeO.Fe_2O_3$) including those commercially available as Mapico Black, these pigments are present in the toner composition in an amount of from about 10 percent by weight to about 70 percent by weight, and preferably in an amount of from about 20 percent by weight to about 50 percent by weight.

Also included within the scope of the present invention are colored toner compositions containing as pigments or colorants, magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone, and anthraquinone dye identified in the Color Index as Cl 60710; Cl Dispersed Red 15, a diazo dye identified in the Color Index as Cl 26050; Cl Sovlent Red 10; Lithol Scarlet; Hostaperm; and the like. Illustrative examples of cyan materials that may be used as pigments include copper tetra-4(octadecyl sulfonamido) phthalocyanine; X-copper phthalocyanine pigment listed in the Color Index as Cl 74160; Cl Pigment Blue; and Anthrathrene Blue, identified in the Color Index as Cl 69810; Special Blue X-2137; Sudan Blue; and the like; while illustrative examples of yellow pigments that may be selected include diarylide yellow 3,3-dichlorobenzidene acetoacetanilides, a monazo pigment identified in the Color Index as Cl 12700; Cl Solvent Yellow 16, a nitrophenyl amine sulfonamide identified in the Color Index as Foron Yellow SE/GLN; Cl Dispersed Yellow 33; 2,5-dimethoxy-4-sulfonanilide phenylazo-4'-chloro-2,5-dimethoxy aceto-acetanilide; Permanent Yellow FGL; and the like. These pigments are generally present in the toner composition in an amount of from about 2 weight percent to about 15 weight percent based on the weight of the toner resin particles.

Illustrative examples of optional charge enhancing additives present in the toner in various effective amounts such as, for example, from 0.1 to about 15 percent by weight, include alkyl pyridinium halides, such as cetyl pyridinium chlorides, reference U.S. Pat. No. 4,298,672, the disclosure of which is totally incorporated herein by reference; dimethyl distearyl ammonium ethyl sulfate, cetyl pyridinium tetrafluoroborates, quaternary ammonium sulfate and sulfonate charge control additives such as stearyl phenethyl dimethyl ammonium tosylates as illustrated in U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and other known similar charge enhancing additives providing the objectives of the present invention are accomplished; and the like.

An important component for the compositions of the present invention is the sulfur containing organopolysiloxane waxes of, for example, the formula as illustrated herein. These waxes, which are available from Stauffer-Wacker Silicones Corporation, are generally present in various effective amounts and can be added as uniformly dispersed internal or as finely divided, uniformly dispersed external components. More specifically, the sulfur containing organopolysiloxane waxes are present in an amount of from about 0.05 percent to about 20 percent by weight. Therefore, for example, as internal additives the waxes are present in an amount of from about 0.5 percent by weight to about 20 percent by weight, while as external components the waxes are present in an amount of from about 0.05 percent by weight to about 5 percent by weight. Toner or toner and developer compositions with the waxes present internally are formulated by initially blending the toner resin particles, pigment particles and waxes, and other optional components. In contrast, when the waxes are present as external additives, the toner compositions is initially formulated comprised of, for example, resin particles and pigment particles; and subsequently there is added thereto the sulfur containing organopolysiloxane waxes illustrated herein. Moreover, the triboelectric charge on the toner composition is generally from about a positive 10 to about a positive 30 microcoulombs per gram, however, depending on the coating present on the carrier particles, for example a coating of a methyl terpolymer, the charge on the toner particles can be from about a -10 to about -30 microcoulombs. Usually, however, the aforementioned toner compositions have incorporated therein charge enhancing additives.

Illustrative examples of carrier particles that can be selected for mixing with the toner compositions of the present invention include those particles that are capable of triboelectrically obtaining a charge of opposite polarity to that of the toner particles. Accordingly, the carrier particles of the present invention can be selected so as to be of a negative polarity thereby enabling the toner particles, which are positively charged, in this embodiment to adhere to and surround the carrier particles. Moreover, the carrier particles of th present invention can be selected to be of a positive polarity thereby enabling the toner particles, which are negatively charged in this embodiment, to adhere to and surround the carrier particles. Illustrative examples of carrier particles that may be selected include granular zircon, granular silicon, glass, steel, nickel, iron, ferrrites, silicon dioxide, and the like. Additionally, there can be selected as carrier particles nickel berry carriers as described in U.S. Pat. No. 3,847,604, the disclosure of which is totally incorporated hereinby reference, which carriers are comprised of nodular carrier beads of nickel characterized by surfaces of reoccurring recesses and protrusions thereby providing particles with a relatively large external area. Other carrier particles selected for the present invention are illustrated in U.S. Ser. No. 751,922 relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel core with a coating thereover of a vinyl chloride/trifluorochloroethylene copolymer, which coating contains therein conductive particles such as carbon black. Also, other coatings include fluoropolymers, such as polyvinylidene fluoride resins; polychlorotrifluoroethene; fluorinated ethylene and propylene copolymers; terpolymers of styrene; methylmethacrylate; and a silane such as triethoxy silane, reference U.S. Pat. Nos. 3,467,634 and 3,526,533, the disclosures of which are totally incorporated herein by reference; polytetrafluoroethylene; fluorine containing polyacrylates and polymethacrylates; and other known coatings. There can also be selected as carrier coatings those as illustrated in copending application Ser. No. 793,042, entitled Developer Compositions With Coated Carrier Particles, the disclosure of which is totally incorporated herein by reference. More specifically, there are illustrated in the aforementioned copending application carriers comprised of a core with two coatings thereover, which are not in close proximity in the triboelectric series, such coatings including, for example, from about 10 to about 90 percent by weight of Kynar, and from about 90 to 10 percent by weight of polymethyl methacrylate.

Also, while the size of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner composition of the present invention can be prepared by a number of known methods including mechanical blending, and melt mixing the toner resin particles, pigment particles or colorants, other additives, and waxes followed by mechanical attrition. Other methods include those well known in the art such as extrusion processing, spray drying, mechanical dispersion, melt dispersion, dispersion polymerization, and suspension polymerization. In one dispersion polymerization method, a solvent dispersion of the resin particles, the pigment particles, wax, and charge enhancing additive are spray dried under controlled conditions. With further respect to the present invention, the waxes are preferably added as external additives, that is subsequent to the preparation of the composition.

Examples of imaging members selected for the electrophotographic imaging process of the present invention include, for example, conventional photoreceptors, such as selenium and selenium alloys. Also useful, especially wherein there are selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadnyl phthalocyanines; while examples of charge transport layers include the diamines as disclosed in U.S. Pat. No. 4,265,990, the disclosure of which is totally incorporated herein by reference.

The following examples are being submitted to further define various species of the present invention. These examples are intended to illustrate and not limit the scope of the present invention. Also, parts and percentages are by weight unless otherwise indicated.

EXAMPLE I

A mercaptopolysiloxane copolymer is prepared by Stauffer-Wacker Silicones Corporation by adding to a reactor equipped with a stirrer, condenser, thermometer and moisture trap, 75 parts of a silane of the formula $$C_nH_{2n+1}Si(OCH_3)_3$$

where n has an average value of 45, to a reactor containing 6.5 parts of 3-mercaptopropyl trimethoxysilane, 12.4 parts of hexamethylcyclo trisiloxane, 5.9 parts of hexamethyl disiloxane, and 100 parts of heptane; and then heating the reactants to a temperature of 61° C. About 81.5 parts of water and 2 parts of acid clay (available from Filtrol Corporation as Filtrol-13) are then added to the reactor. The reactants are heated to a temperature of about 150° C. while removing the aqueous portion of the azeotrope. The contents of the reactor are cooled to about 50° C., then about 10 parts of celite are added, and the mixture filtered.

The filtrate is then vacuum stripped up to 125° C. at less than 1 Torr. The resultant wax melts at 58° C. and has an SH content of 0.05 weight percent.

EXAMPLE II

To a reactor equipped with a stirrer, condenser, thermometer and moisture trap are added 75 parts of a silane of the formula $$C_nH_{2n+1}Si(OCH_3)_3$$

where n has an average value of 45, 70 parts of 3-mercaptopropyl trimethoxysilane, 12.4 parts of hexamethylcyclo trisiloxane, 5.9 parts of hexamethyl disiloxane, and 100 parts of heptane; and then heated to 67° C. About 100 parts of water and 7 parts of acid clay (available from Filtrol Corporation as Filtrol no. 13) are then added. The reactants are heated to a temperature of about 150° C. while removing the aqueous portion of the azeotrope. The contents of the reactor are then cooled to about 50° C., then about 10 parts of celite are added, and the mixture filtered. The filtrate is then vacuum stripped up to 145° C. at less than 1 Torr. The resultant wax has an S content greater than 2 weight percent.

EXAMPLE III

To a reactor equipped with a stirrer, condenser, thermometer and moisture trap are added 75 parts of a silane of the formula $$C_nH_{2n+1}Si(OCH_3)_3$$

where n has an average value of 30, 39 parts of 3-mercaptopropyl trimethoxysilane, 74.4 parts of hexamethylcyclo trisiloxane, 35.4 parts of hexamethyl disiloxane, and 650 parts of heptane. After heating the reactants to a temperature of 70° C., about 489 parts of water and 12 parts of acid clay (available from Filtrol Corporation as Filtrol no. 13) are then added to the reactor. The reactants are heated to a temperature of about 140° C. while removing the aqueous portion of the azeotrope. The contents of the reactor are then cooled to about 50° C., then about 10 parts of celite are added, and the mixture filtered. The filtrate is then vacuum stripped up to 150° C. at less than 1 Torr. The resultant wax has a melting point range of from 44° to 74° C. and contains about 0.6 weight percent SH.

EXAMPLE IV

A toner composition was prepared by melt blending and mechanical attrition, and thereafter dispersing a sulfur containing organopolysiloxane wax onto the toner, thus the wax is present as an external additive. Prior to dispersing the wax, it was jetted to 10 microns average volume medium particle diameter. Subsequent to preparation, the toner composition was comprised of 79 percent by weight of a styrene butadiene copolymer available as Pliolite (91/9) and 16 percent by weight of the magnetite Mapico Black, 4 percent by weight of Regal 330200 carbon black, 1 percent by weight of the charge enhancing additive distearyl dimethyl ammonium methyl sulfate, and 0.2 percent by weight of the sulfur containing organopolysiloxane wax available from Stauffer-Wacker Silicones Corporation as functional polydimethyl siloxane F-705, and prepared in accordance with the process of Example I. Thereafter, the toner was jetted and classified enabling toner particles with an average volume medium diameter of 11 microns. Subsequently, the aforementioned toner, 200 parts by weight, was mixed with carrier particles comprised of a steel core with a first carrier coating, 35 percent by weight, of polyvinylidene fluoride, and a second carrier coating, 65 percent by weight, of polymethyl methacrylate, reference U.S. Ser. No. 793,042, the disclosure of which was previously incorporated herein by reference. The carrier coating weight was 0.7 percent. After mixing the aforementioned formulated developer on a paint shaker for 10 mintes, the triboelectric charge on the toner was a positive 18 microcoulombs per gram, the admix rate was 15 seconds, and there were obtained images of excellent resolution with substantially no background deposits, no offsetting to a silicone fuser roll, and no comets for 150,000 developed copies in a xerographic imaging text fixture containing no silicone oil; and wherein the negatively charged imaging member was comprised of an aluminum supporting substrate, a photogenerating layer of trigonal selenium, and a charge transport layer comprised of 55 percent by weight of N,N'-diphenyl-N,N'-bis(3-methylphenyl) 1,1'-biphenyl-4,4'-diamine dispersed in 45 percent by weight of the polycarbonate Makralon.

The triboelectric charge on the toner was determined by placing 0.5 gram of the above prepared developer composition in a Faraday Cage, followed by blowing away the toner from the carrier. Usually there are desired toners that have a triboelectric charge thereon of from about 10 to about 30 microcoulombs per gram. Also, by admix is meant the rate at which freshly added toner acquires an acceptable triboelectric charge substantially equivalent to the toner present in the xerographic imaging apparatus. Generally, an acceptable admix rate is between about 15 and about 60 seconds. Moreover, the toner admix rate was determined in the known charge spectrograph apparatus.

Additionally, physical observation and optical microscopy indicated that no toner debris accumulated on the photoconductive imaging member, and no unwanted toner spots appeared on the final deeloped output copy for 150,000 imaging cycles.

EXAMPLE V

A toner and developer composition was prepared by repeating the procedure of Example I with the exception that no comets were obtained for 80,000 imaging cycles at which time the test was terminated.

EXAMPLE VI

A toner composition was prepared by repeating the procedure of Example I with the exception that there was selected 0.3 percent by weight of the wax, and substantially similar results were obtained in the imaging test apparatus for 180,000 imaging cycles at which time the test was terminated.

With respect to the above Examples, the imaging test apparatus included a blade cleaning device, and moreover prior to the addition of the wax it was ground to a fine powder resulting in an average volume medium particle diameter of from about 8 to about 15 microns.

EXAMPLE VII

A toner composition was prepared by repeating the procedure of Example I with the exception that no wax was included as an external additive, and there resulted comet deletions after about 30,000 developed copies. The comet deletions occurred to such an extent that the quality of the copies was unacceptable, that is areas of the image were unreadable. Further, optical microscopic evaluation of the photoconductive imaging member indicated that a large amount of impacted toner, about 55 percent, in the form of comets existed on the surface of the member.

Other modifications of the present invention may occur to those skilled in the art subsequent to a review of the present application. The aforementioned modifications, including equivalents thereof, are intended to be included within the scope of the present invention.

What is claimed is:

1. An electrophotographic imaging process which comprises the formation of a latent image on a photoconductive imaging member; thereafter developing the image with a toner composition comprised of resin particles, pigment particles, and a sulfur containing organopolysiloxane wax; subsequently transferring the developed image to a suitable substrate; and permanently affixing the image thereto, wherein there result images with an absence of unwanted toner spots thereon.

2. A process in accordance with claim 1 wherein the sulfur containing organopolysiloxane wax is comprised of:

(1) at least three mole percent of siloxane units of the formula $$R_a-\overset{(R^1)_b}{\overset{|}{Si}}O_{\frac{4-a-b}{2}}$$

(2) at least one mole percent of siloxane units selected from the formulas

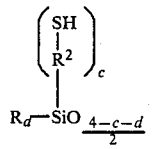

and

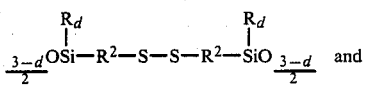

(3) from 0 to 96 mole percent of siloxane units having the formula

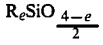

where R is a monovalent hydrocarbon radical having from 1 to 10 carbon atoms, $R^1$ is an alkyl radical linked to silicon with an SiC-bond which has at an average of least 25 carbon atoms, $R^2$ is a multivalent radical selected from a hydrocarbon radical having from 2 to 10 carbon atoms and which radical is free of aliphatic unsaturation, a hydrocarbon ether or a hydrocarbon thioether, a is an integer of from 0 to 2, b is an integer of 1 or 2, c is an integer of 1 or 2, d is an integer of from 0 to 2, e is an integer of from 0 to 3, and the sum of a+b is 1, 2 or 3, and the sum of c+d is 1, 2 or 3.

3. A process in accordance with claim 1 wherein the wax is present as an external additive.

4. A process in accordance with claim 1 wherein the resin particles are selected from the group consisting of polyesters, styrene butadiene copolymers, styrene acrylates, or styrene methacrylate copolymers.

5. A process in accordance with claim 1 wherein the pigment particles are carbon black, magnetite or mixtures thereof.

6. A process in accordance with claim 1 wherein the pigment particles are selected from the group consisting of magenta, cyan, yellow and mixtures thereof.

7. A process in accordance with claim 1 wherein the toner contains a charge enhancing additive.

8. A process in accordance with claim 7 wherein the charge enhancing additive is selected from the group consisting of distearyl dimethyl ammonium methyl sulfate, cetyl pyridinium halides, and stearyl phenethyl dimethyl ammonium tosylate.

9. A process in accordance with claim 1 wherein the sulfur wax is present in an amount of from about 0.05 to about 5 percent by weight.

10. A process in accordance with claim 1 wherein the toner composition is admixed with carrier particles.

11. A process in accordance with claim 10 wherein the carrier particles contain a coating thereover.

12. A process in accordance with claim 10 wherein the carrier particles are comprised of a steel core coated with a polychlorotrifluoroethylene-co-vinylchloride copolymer, a polyvinylidene fluoropolymer, a terpolymer of styrene, methacrylate, and vinyltriethoxysilane, fluorinated ethylene-propylene copolymers, or polytetrafluoroethylene.

13. A process in accordance with claim 10 wherein a silicone fuser roll is selected from affixing the image.

14. A process in accordance with claim 10 wherein a Viton fuser roll is selected from affixing the image.

15. A process in accordance with claim 10 wherein the carrier particles are selected from the group consisting of ferrites, steel and iron.

16. A process in accordance with claim 15 wherein the carrier particles contain a coating thereover.

17. A process in accordance with claim 1 wherein the triboelectric charge on the toner composition is from about 10 to about 30 microcoulombs per gram.

18. A process in accordance with claim 11 wherein the carrier coating is comprised of a first polymer and a second polymer, which polymers are not in close proximity in the triboelectric series.

19. A process in accordance with claim 18 wherein the first polymer is present in an amount of from about 10 to about 90 percent by weight, and the second polymer is present in an amount of from about 10 to about 90 percent by weight.

20. A process in accordance with claim 18 wherein the first polymer is a polyvinylidene fluoride, and the second polymer is a polymethylmethacrylate.

21. A xerographic process wherein there results images with an absence of unwanted toner spots thereon which comprises the formation of a latent image on a photoconductive imaging member; thereafter developing the image with a toner composition comprised of resin particles, pigment particles and sulfur containing organopolysiloxane wax; subsequently transferring the developed image to a suitable substrate; and permanently affixing the image thereto.

22. A process in accordance with claim 21 wherein there is avoided the localized accumulation of undesirable toner debris on the photoconductive imaging member.

23. A process in accordance with claim 21 wherein offset preventing fluids are avoided.

24. A process in accordance with claim 21 wherein the sulfur containing organopolysiloxane wax is comprised of:

(1) at least three mole percent of siloxane units of the formula

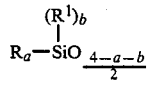

(2) at least one mole percent of siloxane units selected from the formulas

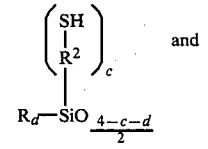

and

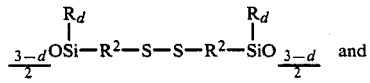

(3) from 0 to 96 mole percent of siloxane units having the formula

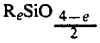

where R is a monovalent hydrocarbon radical having from 1 to 10 carbon atoms, $R^1$ is an alkyl radical linked to silicon with an SiC-bond which has at an average of least 25 carbon atoms, $R^2$ is a multivalent radical selected from a hydrocarbon radical having from 2 to 10 carbon atoms and which radical is free of aliphatic unsaturation, a hydrocarbon ether or a hydrocarbon thioether, a is an integer of from 0 to 2, b is an integer of 1 or 2, c is an integer of 1 or 2, d is an integer of from 0 to 2, e is an integer of from 0 to 3, and the sum of a+b is 1, 2 or 3, and the sum of c+d is 1, 2 or 3.

25. A process in accordance with claim 21 wherein the toner composition contains a charge enhancing additive.

26. A process in accordance with claim 25 wherein the charge enhancing additive is selected from the group consisting of distearyl dimethyl ammonium methyl sulfate, cetyl pyridinium halides, and stearyl phenethyl dimethyl ammonium tosylate.

27. A process in accordance with claim 21 wherein the toner composition is admixed with carrier particles.

28. A xerographic imaging process wherein there results images with an absence of unwanted toner spots thereon which comprises the formation of a latent image on a photoconductive imaging member; thereafter developing the image with a toner composition comprised of resin particles, pigment particles and sulfur containing organopolysiloxane wax comprised of:

(1) at least three mole percent of siloxane units of the formula $$R_a-\overset{(R^1)_b}{\overset{|}{Si}}O_{\frac{4-a-b}{2}}$$

(2) at least one mole percent of siloxane units selected from the formulas $$\left(\overset{SH}{\overset{|}{R^2}}\right)_c \quad \text{and}$$
$$R_d-SiO_{\frac{4-c-d}{2}}$$

$$\overset{R_d}{\overset{|}{O_{\frac{3-d}{2}}Si}}-R^2-S-S-R^2-\overset{R_d}{\overset{|}{SiO_{\frac{3-d}{2}}}} \quad \text{and}$$

(3) from 0 to 96 mole percent of siloxane units having the formula $$R_eSiO_{\frac{4-e}{2}}$$

where R is a monovalent hydrocarbon radical having from 1 to 10 carbon atoms, $R^1$ is an alkyl radical linked to silicon with an SiC-bond which has at an average of least 25 carbon atoms, $R^2$ is a multivalent radical selected from a hydrocarbon radical having from 2 to 10 carbon atoms and which radical is free of aliphatic unsaturation, a hydrocarbon ether or a hydrocarbon thioether, a is an integer of from 0 to 2, b is an integer of 1 or 2, c is an integer of 1 or 2, d is an integer of from 0 to 2, e is an integer of from 0 to 3, and the sum of a+b is 1, 2 or 3, and from sum of c+d is 1, 2 or 3; subsequently transferring the developed image to a suitable substrate; and permanently affixing the image thereof.

* * * * *